United States Patent [19]

Heren

[11] Patent Number: 4,997,131

[45] Date of Patent: Mar. 5, 1991

[54] BALL VALVE PISTOL NOZZLE

[75] Inventor: Lawrence P. Heren, Peoria, Ill.

[73] Assignee: L. R. Nelson Corporation, Peoria, Ill.

[21] Appl. No.: 404,356

[22] Filed: Sep. 7, 1989

[51] Int. Cl.[5] ..... B05B 9/01

[52] U.S. Cl. ..... 239/397.5; 239/526; 239/581.1

[58] Field of Search ..... 239/390, 526, 530, 581.1, 239/397.5; 251/172, 174; 222/472, 473, 474

[56] References Cited

U.S. PATENT DOCUMENTS

| | | | |
|---|---|---|---|
| 2,930,575 | 3/1960 | Britton | 251/174 |
| 2,989,250 | 6/1961 | Simon | 239/526 |
| 3,001,725 | 9/1961 | Lockett | 239/530 |
| 3,319,893 | 5/1967 | Rodgers et al. | 239/526 |
| 4,166,579 | 9/1979 | Beise et al. | 239/526 |

*Primary Examiner*—Andres Kashnikow
*Assistant Examiner*—Karen B. Merritt
*Attorney, Agent, or Firm*—Cushman, Darby & Cushman

[57] ABSTRACT

A hose nozzle comprising a fixed body structure including a hand grip portion and a barrel portion extending at an angle therefrom. The hand grip portion has exterior surfaces shaped to be gripped forwardly by the fingers of a user's hand and rearwardly by the palm with a rearwardly projecting abutment overlying the base of the thumb. A flow control knob is mounted on the hand grip portion above the abutment for turning movement through 90° about a fore and aft extending axis in a position to be conveniently turned by the thumb of the user's hand gripping the hand grip portion. The body structure defines an interior water passage including an inlet passage portion extending through the hand grip portion in temperature insulating relation with respect to the exterior surfaces thereof. A ball valve is mounted within the inlet passage portion for movement in response to the movement of the control knob. A spray pattern defining assembly is mounted on the outlet end of the interior water passage.

24 Claims, 2 Drawing Sheets

BALL VALVE PISTOL NOZZLE

BACKGROUND OF THE INVENTION

This invention relates to nose nozzles and more particularly to hose nozzles of the pistol grip type.

Pistol grip hose nozzles have been known for many years and have received widespread commercial usage in the last thirty years. The most prevalent type of commercial pistol grip hose nozzle embodies a rigid hollow nozzle body including a hand grip portion having its lower end open and interiorly threaded to receive a male hose fitting for communicating a source of water under pressure to the hollow interior of the hand grip portion. Extending forwardly at an angle from the upper end of the hand grip portion is an integral barrel portion having a forward end formed with an outlet orifice. A flow control rod is mounted within the barrel portion and includes a forward annular water shut off ring normally spring urged to engage a shut off washer disposed inwardly of the outlet orifice and a control stem extending through the orifice to vary the flow rate and discharge pattern in accordance with its relative axial position within the orifice. The control rod extends rearwardly outwardly of the barrel portion through a suitable seal and its rearward extremity is threaded to adjustably receive a knob thereon. An elongated actuating lever is pivoted to the nozzle in a position such that an elongated lower portion is normally disposed in rearwardly spaced relation along the hand grip portion of the nozzle body and a shorter upper portion is connected to move with the adjustable knob. Pistol grip hose nozzles of this type are disclosed in numerous patents, early examples of which are U.S. Pat. Nos. 2,536,167 and Des. 148,892.

Pistol grip hose nozzles of the type described above are manually actuated by manually gripping in one hand both the hand grip portion of nozzle body and the elongated lower portion of the actuating lever. The extent of the movement of the actuating lever by a simple squeezing action simultaneously determines the flow rate and spray pattern. When it is desired to maintain the flow rate and spray pattern at one position, it is necessary to hold the actuating lever in such position against the spring bias. Alternatively, the operator could flip a bail from its normal inoperative position into an operative position holding the actuating lever in an actuated position. The position of the control rod for that retained actuated position could be adjusted by manually adjusting the position of the knob.

Efforts have been made over the years to provide cost effective improvements which make pistol grip hose nozzles more convenient, more comfortable and easier to use. For example, more comfort has been provided by insulating the hand grip portion of the hose nozzle body. One such insulating arrangement which has received commercial acceptance is disclosed in U.S. Pat. No. 3,799,447. U.S. Pat. No. 4,776,517 discloses a presently commercially available pistol grip hose nozzle which not only embodies an insulating handle improvement but an additional improvement of convenience which facilitates use by replacing the long rearwardly disposed actuating lever with a simple one finger trigger actuation plus a thumb actuated trigger retaining member. Moreover, since the insulating function was obtained by mounting exterior shell parts over an interior water handling body, a desirable ornamental configuration could be readily imparted to the nozzle.

While the improved pistol grip hose nozzles described above have achieved commercial acceptance, there is always the need to provide more cost effective structures which perform commercially in a comparable or improved manner.

SUMMARY OF THE INVENTION

It is an object of the present invention to fulfill the above-described need. In accordance with the principles of the present invention, this objective is accomplished by providing a hose nozzle comprising a fixed body structure including a hand grip portion and a barrel portion extending at an angle from the hand grip portion. The hand grip portion has exterior surfaces shaped to be gripped forwardly by the fingers of a user's hand and rearwardly by the palm with a rearwardly projecting abutment overlying the base of the thumb. A flow control knob is mounted on the hand grip portion above the abutment for turning movement through 90° about a fore and aft extending axis in a position to be conveniently turned by the thumb of the user's hand gripping the hand grip portion. The body structure defines an interior water passage including an inlet passage portion extending through the hand grip portion in temperature insulating relation with respect to the exterior surfaces thereof and an outlet passage portion extending from the inlet passage portion through the barrel portion. The inlet passage portion has an inlet end formed with a coupling for connection with a hose end fitting so as to communicate a source of water under pressure contained within a hose with the inlet passage portion. A ball valve seat is provided in the inlet passage portion in spaced relation with the inlet end in a position adjacent the outlet passage portion and a ball valve is mounted in the hand grip portion in cooperating relation with the ball valve seat in a position within the inlet passage portion for movement through 90° between opened and closed positions to control the flow of water under pressure communicated with the inlet passage portion to the outlet passage portion past the valve seat from zero flow when the ball valve is in its closed position to full flow when the ball valve is in its opened position and varying flow rates therebetween when the ball valve is in varying positions between its closed and opened positions. The knob is connected with the ball valve so that the position the knob is moved into by the user's thumb determines the flow rate of the water under pressure flowing to the outlet passage portion. A spray pattern defining assembly is positioned in an outlet end of the outlet passage portion for causing water under pressure flowing to the outlet end to be discharged therefrom in a predetermined spray pattern.

The body structure may comprise a unitary metal body defining the inlet passage portion, the outlet passage portion and the barrel portion with the exterior surfaces of the hand grip portion being provided by a body of elastomeric material molded exteriorly to the metal body in surrounding relation to the inlet passage portion. Alternatively, the body structure may be made entirely of plastic material. The manner of constructing the body structure entirely with plastic material involves a construction which has applicability to hose nozzles utilizing control valves other than ball valves. Accordingly, it is a further object of the present invention to provide such a nozzle construction. In accordance with the principles of the present invention, this objective is obtained by providing a hose nozzle comprising a molded plastic body including a hand grip portion and a barrel portion extending at an angle from the hand grip portion. The barrel portion defines an outlet passage portion extending inwardly from an outlet end thereof to a position of juncture between the barrel portion and the hand grip portion. The hand grip portion includes an inner conduit section leading to the outlet passage portion and an outer annular wall surrounding the inner conduit section, the annular wall having an open end spaced from the juncture of the hand grip portion with the barrel portion and the exterior surfaces shaped for manual engagement by a user. A molded plastic inlet structure is provided which includes a closure section mounted in substantial closing relation to the open end of the annular wall. The closure section has an inlet hose coupling therein for communicating therewith a source of water under pressure contained in a hose and an inlet conduit section extending inwardly from the coupling in spaced relation with the annular wall into communicating relation with the inner conduit section of the body member so that the inlet conduit section, the inner conduit section and the outlet passage portion define a water passage extending from the coupling means to the outlet end which is disposed in temperature insulating relation with respect to the manually engageable exterior surfaces of the annular wall. A valve is mounted in the water passage for manual movement between opened and closed positions with respect to the water passage for controlling flow of water under pressure communicated with the coupling with the outlet end. A spray pattern defining assembly is mounted in the outlet end for directing water under pressure flowing to the outlet end outwardly thereof in a predetermined spray pattern.

These and other objects of the present invention will become more apparent during the course of the following detailed description and appended claims.

The invention may best be understood with reference to the accompanying drawings wherein illustrative embodiments are shown.

DESCRIPTION OF THE PREFERRED EMBODIMENTS

Figures 1, 2:
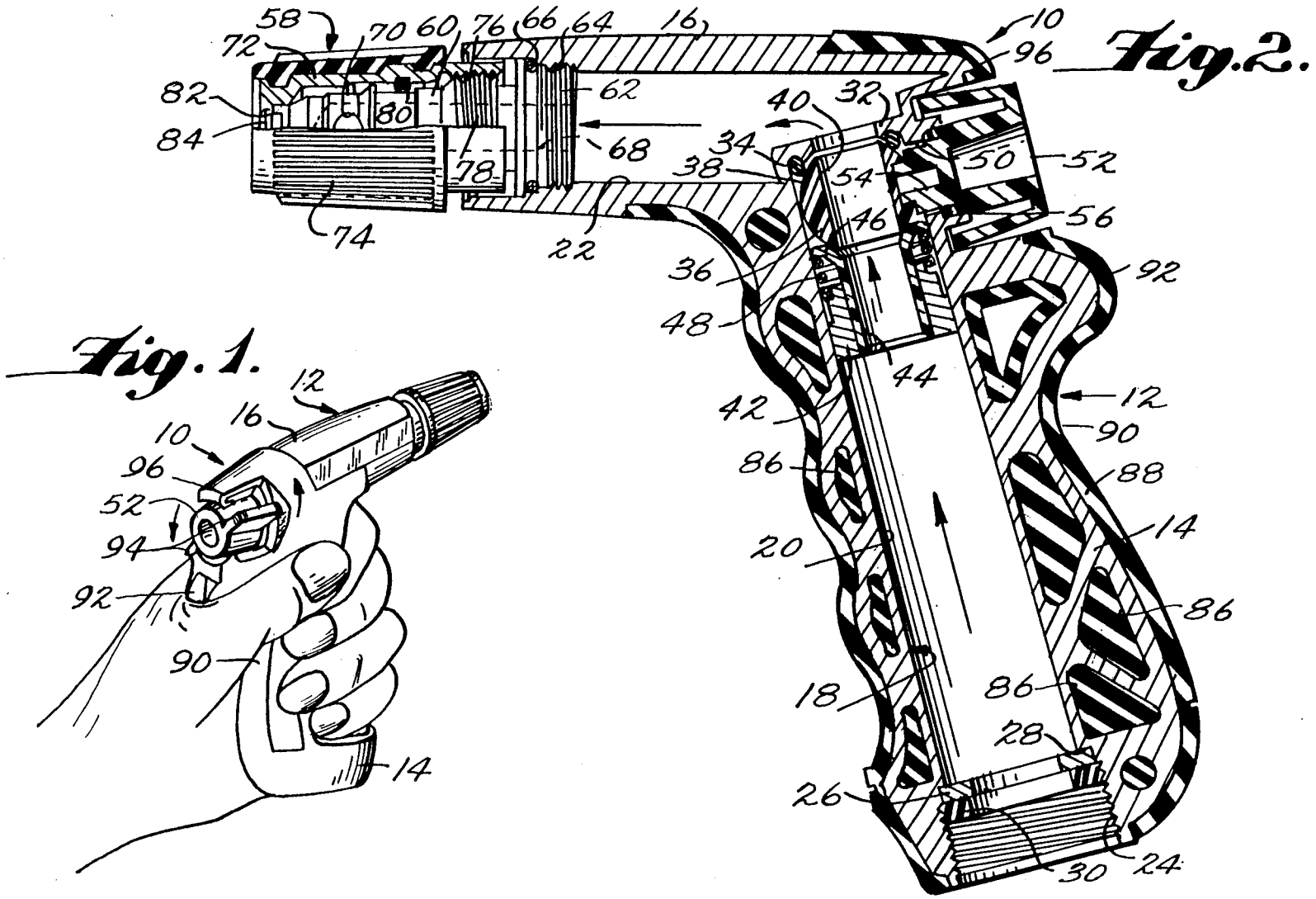
FIG. 1 is a perspective view of a pistol grip hose nozzle embodying the principles of the present invention, showing how the pistol grip nozzle is gripped in operation.
FIG. 2 is a vertical sectional view of the pistol grip hose nozzle shown in FIG. 1.

Referring now more particularly to FIGS. 1 and 2 of the drawings, there is shown therein a pistol grip hose nozzle, generally indicated at 10, which embodies the principles of the present invention. As shown, the hose nozzle 10 includes a fixed body structure, generally indicated at 12, including a hand grip portion 14 and a barrel portion 16 extending at an angle from the hand grip portion 14. The body structure 12 defines an interior water passage, generally indicated at 18, including an inlet passage portion 20 extending through the hand grip portion 14 and an outlet passage portion 22 extending from the inlet passage portion 20 through said barrel portion 16. The inlet passage portion 20 has an inlet end formed with interior threads 24 which constitute a female coupling or fitting for interengaging with a conventional male hose fitting (not shown) for purposes of communicating a supply of water under pressure with the interior water passage. As shown, a metal washer 26 is fitted within a shoulder 28 spaced inwardly of the threads 24 to receive the usual resilient washer 30.

Formed in the junction between the inlet passage portion 20 and the outlet passage portion 22 is an apertured wall 32 formed therein. Mounted within the wall and facing in a direction toward the inlet is an 0-ring seal 34 which constitutes a ball valve seat cooperatively receiving a ball valve member 36. As shown, the ball valve member 36 includes a partially generally spherical exterior peripheral surface 38 which engages the valve seat 34. The ball valve member 36 also includes a through passage 40 which, when aligned with valve seat 34 communicates the water under pressure coming from the inlet passage portion 20 to the outlet passage portion 22.

Mounted within the inlet passage portion 20 downstream from the ball valve member 36 is an annular mounting member or sleeve 42 having an exterior periphery rigidly engaging the interior of the inner passage portion and an interior cylindrical surface which slidably receives a tubular member 44. The tubular member 44 includes a flared end portion 46 which engages the exterior spherical surface 38 of the ball valve member 36. The flared end portion 46 is flanged to receive one end of a coil spring 48, the opposite end of which engages the sleeve or mounting member 42. The spring 48 serves to resiliently urge the flared end portion 46 of the tubular member 44 into engagement with the ball valve member 36 and, in turn, to maintain the ball valve member 36 in sealing engagement with the seat provided by the O-ring seal 34. It can be seen that water entering the inlet of the inlet passage portion 20 will pass through the tubular member 44 and into the passage 40 of the ball valve member 35 when the latter is communicated therewith and outwardly thereof through the passage 40 and into the outlet passage portion 22. The water pressure as well as the spring pressure serve to bias the ball valve member 36 to be retained in any position it is manually moved between a fully opened aligned position, as shown, and a closed position displaced 90° from the open position shown.

It will be noted that the body structure 12 at a position rearwardly of the ball valve member 36 is formed with an opening 50 having a counterbore formed therein. A valve actuating knob 52 includes a forward stem portion 54 which extends through the opening 50 and has a fixed connection with the ball valve member 36 as by sonic welding or the like. An O-ring seal 56 seats within the counterbore of the opening 50 and engages an associated peripheral portion of the knob 52 and serves to rotatably sealingly mount the knob 52 within the body structure 12 for turning movements about a fore and aft extending axis which is generally perpendicular to the axis at the inlet passage portion 20. In this way, the ball valve member 36 is secured to the knob 52 so that manual movements imparted to the knob 52 serve to effect corresponding movements of the valve member 36.

The forward end of the outlet passage portion 22 has an appropriate stream directing assembly, generally indicated at 58, mounted therein which receives the water under pressure flowing in the outlet passage portion 22 and directs the same in a predetermined discharge pattern from the forward end of the barrel portion 16.

Preferably, the stream directing assembly 58 is of the adjustable type and includes an inner member 60 having an inner end exteriorly threaded, as indicated at 62, to engage with cooperating interior threads 64 formed in the forward end of the outer passage portion 22. An O-ring seal 66 serves to prevent leakage beyond the threaded connection between the exterior of the inner member 60 and the fixed body structure 12.

Extending inwardly of the inner member 62 from the threaded end thereof is an axially extending bore 68 forming a water flow path through the inner member to a pair of radially outwardly extending openings 70 which serve to communicate the water to the central interior of an outer tubular member 72 disposed in surrounding relation with the inner member 62. As shown, the outer member 72 is a composite member formed of an inner annular metal portion having a outer annular elastomeric portion molded thereto. The elastomeric portion is provided with exterior ridges 74 to facilitate turning of the outer member 72 and in this regard the rearward interior of the outer member 72 is formed with interior threads 76 which meshingly engage exterior threads 78 formed on an adjacent exterior periphery of the inner member 69 so that turning movements of the outer member 72 with respect to the inner member 60 will result in axial movements as well.

The exterior periphery of the inner member 60 includes a cylindrical surface disposed forwardly of the threads 78 which is sealingly engaged by an O-ring seal 80 carried within an interior groove formed on the interior of the outer tubular member 72. The forward end of the outer tubular member 72 is formed with an outlet orifice 82 and the forward end of the inner member 60 is formed with a stem portion 84 of conventional configuration. It will be noted that when the outer member 72 is turned into a fully retracted position as shown with respect to the inner member 60, a rearwardly facing sealing surface adjacent the orifice engages a forwardly facing sealing surface on the inner member 60 to close off flow through the stream directing assembly 58. As the outer tubular member 72 is turned with respect to the inner member 60, the interengaging shut-off surfaces are moved axially apart allowing for flow of water through the orifice 82 and past the stem portion 84. The arrangement by which the rate of flow and flow pattern are controlled by turning the outer tubular member 72 and moving the stem portion 84 axially within the orifice 82 is conventional in nature.

The fixed body structure 12 of the hose nozzle shown in FIGS. 1 and 2 preferably comprises a main zinc casting. The casting at the hand grip portion 14 is thickened forwardly and rearwardly to provide an exterior hand grip contour, the thickened portions having voids or openings 86 extending laterally therethrough to thereby reduce the amount of zinc utilized in the casting. The voids or openings 86 also serve a retention function for an elastomeric body 88 which is molded over the exterior contour of the hand grip portion so as to provide a final exterior surface contour 90 which is insulated by the elastomeric material from the water flowing in the water passage 18 including the inlet passage portion 20. The exact configuration of the surface contour 90 can be varied. However, a preferred specific embodiment is disclosed in commonly assigned and concurrently filed design application, U.S. Pat. No. 07/404,363, the disclosure of which is hereby incorporated by reference into the present application.

As shown, the forward portion includes finger receiving indentations and the rearward portion includes an abutment 92 which extends over the base of the thumb. The ball valve engaging knob 52 is located just above the abutment 92 and includes diametrically opposed thumb engaging radially extending portions 94. As can be seen from FIG. 1, a user grasping the exterior surfaces 90 provided by the body of elastomeric material will have his thumb in a position to be easily extended into engagement with the adjacent thumb-engaging knob portion 94 to thereby move the knob through into any position within the 90° travel provided. In this regard, it will be noted that an extension of the rearward end of the barrel portion of the zinc casting and a comparable cover from the body of elastomeric material extend above the knob and provide a ledge 96 for protecting the knob 52 from damage as by direct hard surface contact from above, just as the abutment 92 provides comparable protection from the rear.

Figures 3, 4:
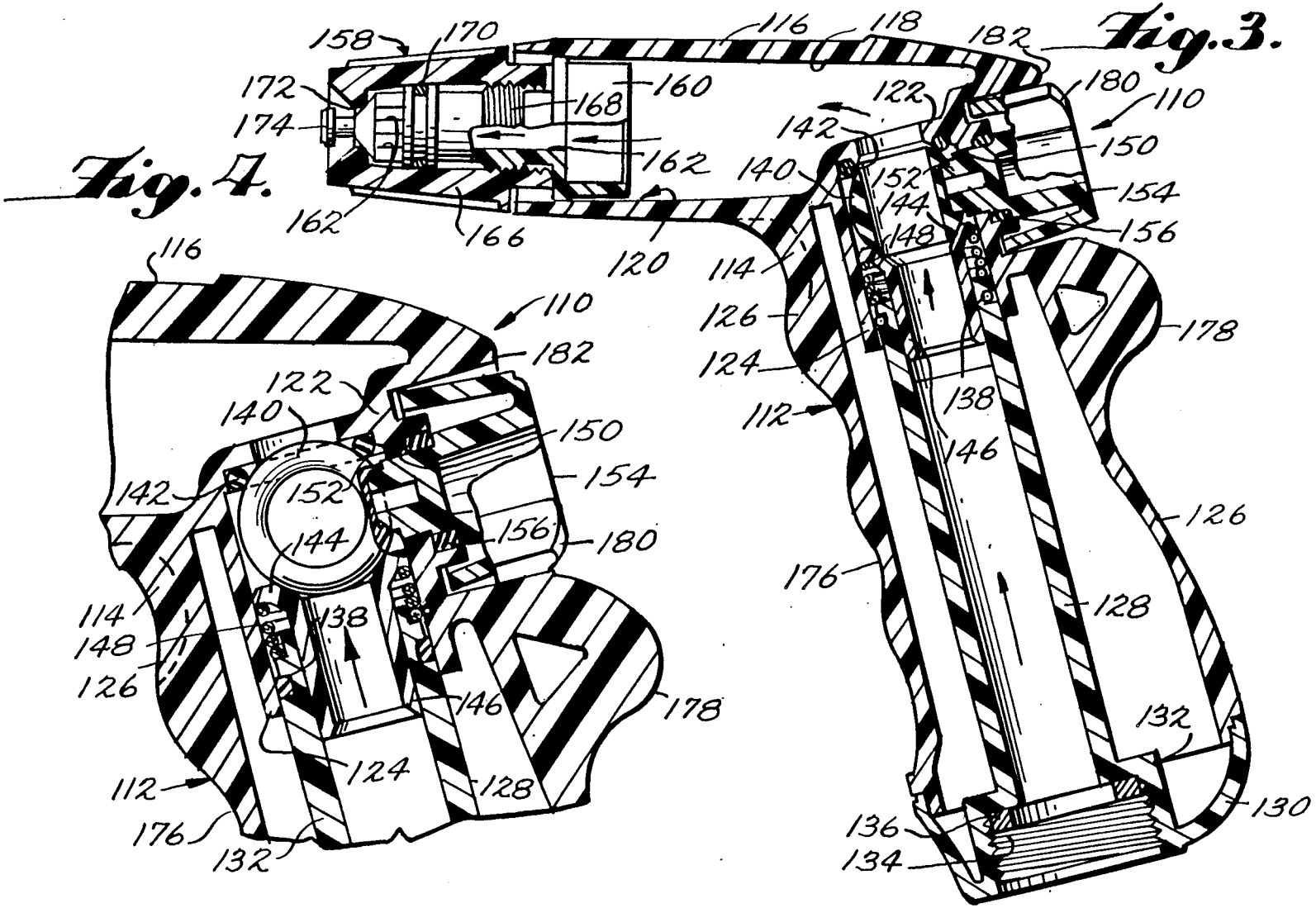
FIG. 3 is a view similar to FIG. 2 of another embodiment of a pistol grip hose nozzle embodying the principles of the present invention.
FIG. 4 is an enlarged fragmentary sectional view showing the ball valve moved into its closed position.

Referring now more particularly to FIGS. 3 and 4, there is shown therein another embodiment of a hand grip hose nozzle, generally indicated at 110, which embodies the principles of the present invention. The hose nozzle 110 includes a fixed body structure, generally indicated at 112, which consists essentially of two molded plastic parts one of which is a body member 114 defining a barrel portion 116 of the body structure having formed therein an outlet passage portion 118 of a interior water passage, generally indicated at 120, within the fixed body structure 112. The plastic body member 114 also includes an apertured wall 122 at the rearward end of the outlet passage portion 118. Extending from the apertured wall 122 in a direction aWay from the outlet passage portion 118 is an inner conduit section 124 and an outer annular wall 126 surrounds the inner conduit section 124 and extends beyond the same terminating in an open end.

The annular wall 126 forms an exterior part of a hand grip portion of the fixed body structure 112, the remainder of which is provided by the second molded plastic part, which is an inlet member 128 including a closure section 130 mounted in substantial closing relation to the open end of the annular wall 124.

Extending upwardly with respect to the central portion of the closure section 130 is an inner conduit section 132, the lower extremity of which is enlarged and provided with interior threads 134 forming a female coupling for engagement with the exterior threads of a male coupling or fitting (not shown) for a water supplying hose. The usual washer 136 is mounted in the shoulder formed by the enlarged conduit section 132 adjacent the threads 134.

The opposite free end of the inlet conduit section 132 extends within the inner conduit section 124 of the body member 126. In this regard, the inner end portion of the conduit section 132 is grooved exteriorly to receive an O-ring seal 138 which engages the interior periphery of the conduit section 124. As before, a centrally apertured ball valve member 140 is mounted between an O-ring valve seat 142 formed in the apertured wall 122 and the flared end portion 144 of a tubular member 146 slidably mounted within the interior of the conduit section 132. As before, a coil spring 148 is mounted between the end of the interior conduit section 132 and the flanged flared end portion 144 of the tubular member 146. Also as before, the inner conduit section 124 is formed with an opening 150 for receiving a stem portion 152 of a knob 154 which is fixedly secured to the ball valve member 140. An O-ring seal 156 serves to seal the stem portion 152 with respect to the fixed body structure 112. The ball valve member 14 is thus moved by the knob 154 about a fore and aft extending axis which is generally perpendicular to the axis of the conduit sections 124 and 132.

As before, the forward end of the outlet passage portion 118 has a stream directing assembly, generally indicated at 158, mounted therein. The assembly 158, as shown in FIG. 4, includes an inner member 160 having a rearward end which is fixed as by sonic welding or the like within the interior of the outlet passage portion 118 of the barrel portion 116 of the body structure 112. The inner member 160 includes water passage 162 extending forwardly toward the opposite end which communicates with lateral openings 164. An outer tubular member 166 has the interior of its rearward end internally threaded to meshingly engage exterior threads 168 on the outer periphery of the inner member. The outer member 166 includes an interior cylindrical periphery which sealingly engages an O-ring 170 mounted within an exterior annular groove formed in the exterior periphery of the inner member 160. Finally, the forward end of the outer member 166 is formed with an orifice 172 within which a stem portion 174 on the forward end of the inner member 160 extends. As before, there are cooperating annular shut-off surfaces which interengage when the outer member 166 is fully retracted and axially separate as the outer member 166 is extended by turning with respect to the inner member 160.

It will be noted that the hand grip portion 114 of the body member 126 includes an exterior surface contour 176 which provides finger indentations at the forward area thereof and an abutment 178 at the upper rear area thereof for engaging over the base of the thumb when the hand grip portion is gripped by a user. As before, the knob 154 is disposed above and forwardly of the abutment 178 and includes two radially extending thumb-engaging levers 180 by which the user can conveniently effect movement of the ball valve member from the fully opened position shown in FIG. 3 to the fully closed position shown in FIG. 4. As before, a ledge portion 182 is provided by the fixed body structure 112 in a protective position above the knob 154. The ball valve member 14 of hose nozzle 110 has the same operating characteristic as the ball valve member 36 of the hose in nozzle 10 that it will be retained by the water pressure and spring pressure into any position into which it is moved by the operator intermediate the fully opened and fully closed position. Thus, the position of the knob 154 serves to control the flow rate through the stream directing assembly 158 whereas the adjustment of the latter provides for variation in the shape of the discharge from a cone-shaped spray to a jet stream.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A hose nozzle comprising a fixed body structure including a hand grip portion and a barrel portion extending at an angle from said hand grip portion, said hand grip portion having exterior surface means shaped to be gripped forwardly by the fingers of a user's hand and rearwardly by the palm with a rearwardly projecting abutment overlying the base of the thumb, a flow control knob mounted on said hand grip portion above said abutment for turning movement through 90° about a fore and aft extending axis in a position to be conveniently turned by the thumb of the user's hand gripping the hand grip portion, said body structure defining an interior water passage including an inlet passage portion extending through said hand grip portion in temperature insulating relation with respect to the exterior surface means thereof and an outlet passage portion extending from said inlet passage portion through said barrel portion, said inlet passage portion having an inlet end formed with coupling means for connection with a hose end fitting so as to communicate a source of water under pressure contained within a hose with said inlet passage portion, a ball valve seat in said inlet passage portion in spaced relation with said inlet end in a position adjacent the outlet passage portion, a ball valve mounted in said hand grip portion in cooperating relation with said ball valve seat in a position within said inlet passage portion for movement through 90° between opened and closed positions to control the flow of water under pressure communicated with said inlet passage portion to said outlet passage portion past said valve seat from zero flow when said ball valve is in said closed position to full flow when said ball valve is in said opened position and varying flow rates therebetween when said ball valve is in varying positions between said closed and opened positions, means for connecting said knob with said ball valve so that the position the knob is moved into by the user's thumb determines the flow rate of the water under pressure flowing to said outlet passage portion, and manually adjustable spray pattern defining means in an outlet end of said outlet passage portion for causing water under pressure flowing to said outlet end to be discharged therefrom in a selected predetermined spray pattern within a manually adjustable range of spray patterns between a jet stream and a cone spray.

2. A hose nozzle as defined in claim 1 wherein said fixed body structure comprises a unitary metal body defining said inlet passage portion, said outlet passage portion and said barrel portion, said exterior surface means of said hand grip portion being provided by a body of elastomeric material molded exteriorly to said metal body in surrounding relation to said inlet passage portion.

3. A hose nozzle as defined in claim 2 wherein said ball valve seat comprises an O-ring seated in an annular groove formed in an inner end portion of said inlet passage portion and sealingly engaging a first annular portion of said ball valve.

4. A hose nozzle as defined in claim 3 wherein said ball valve is mounted for movement between said opened and closed positions by a tubular member having an outwardly flared inner end portion engaging a spaced generally opposed annular portion of said ball valve, and spring means for resiliently biasing said tubular member in the direction of engagement with said ball valve.

5. A hose nozzle as defined in claim 4 wherein said spring means comprises a coil spring mounted between said tubular member and a tubular support fixed within said inlet passage portion.

6. A hose nozzle as defined in claim 2 wherein said manually adjustable spray pattern defining means comprises a stem member having one end fixed to said outlet end and extending outwardly therefrom, said stem member including a stream deflecting stem on an outwardly extending end of said stem member and a cylindrical exterior surface spaced inwardly from said stream deflecting stem said stem member having flow opening means extending through said one end thereof to the exterior thereof between said stream deflecting stem and said exterior cylindrical surface, said spray pattern defining means also comprising a sleeve member threadedly mounted on said stem member, said sleeve member having interior sealing means engaging said exterior cylindrical surface and a forward end having a nozzle orifice therein movable with respect to said stream deflecting stem in response to turning movements of said sleeve member into varying stream defining positions including a jet stream defining position wherein said nozzle orifice is in an extended spaced position with respect to said stream deflecting stem and a cone spray defining position wherein said nozzle orifice is in a closely spaced position with respect to said stream deflecting stem.

7. A hose nozzle as defined in claim 1 wherein said fixed body structure comprises a molded plastic body member defining said barrel portion and said outlet passage portion extending therein, said plastic body member including a first inner conduit section leading to said outlet passage portion and an outer annular wall surrounding said first inner conduit section, said annular wall having an open end spaced from the juncture of said hand grip portion and said barrel portion, said annular wall providing said exterior surface means and a molded plastic inlet member including a closure section mounted in closing relation to the open end of said annular wall, said coupling means being provided in said closure section, said inlet member also including a second inlet conduit section defining said inlet passage portion extending inwardly from said coupling means in spaced relation with said annular wall into communicating relation with said first inner conduit section so that said second inlet conduit section, said first inner conduit section and said outlet passage portion define a water passage extending from said coupling means to said outlet end which is disposed in temperature insulating relation with respect to said manually engageable exterior surface means of said annular wall.

8. A hose nozzle as defined in claim 7 wherein said ball valve seat comprises an O-ring seated in an annular groove formed in an inner end portion of said first inner conduit section and sealingly engaging a first annular portion of said ball valve.

9. A hose nozzle as defined in claim 7 wherein said ball valve is mounted for movement between said opened and closed positions by a tubular member having an outwardly flared inner end portion engaging a spaced generally opposed annular portion of said ball valve, and spring means for resiliently biasing said tubular member in the direction of engagement with said ball valve.

10. A hose nozzle as defined in claim 9 wherein said spring means comprises a coil spring mounted between said tubular member and an inner end of said second inlet conduit section.

11. A hose nozzle as defined in claim 2 wherein said manually adjustable spray pattern defining means comprises a stem member having one end fixed to said outlet end and extending outwardly therefrom, said stem member including a stream deflecting stem on an outwardly extending end of said stem member and a cylindrical exterior surface spaced inwardly from said stream deflecting stem said stem member having flow opening means extending through said one end thereof to the exterior thereof between said stream deflecting stem and said exterior cylindrical surface, said spray pattern defining means also comprising a sleeve member threadedly mounted on said stem member, said sleeve member having interior sealing means engaging said exterior cylindrical surface and a forward end having a nozzle orifice therein movable with respect to said stream deflecting stem in response to turning movements of said sleeve member into varying stream defining positions including a jet stream defining position wherein said nozzle orifice is in an extended spaced position with respect to said stream deflecting stem and a cone spray defining position wherein said nozzle orifice is in a closely spaced position with respect to said stream deflecting stem.

12. A hose nozzle as defined in claim 11 wherein said ball valve seat comprises an O-ring seated in an annular groove formed in an inner end portion of said inlet passage portion and sealingly engaging a first annular portion of said ball valve.

13. A hose nozzle as defined in claim 12 wherein said ball valve is mounted for movement between said opened and closed positions by a tubular member having an outwardly flared inner end portion engaging a spaced generally opposed annular portion of said ball valve, and spring means for resiliently biasing said tubular member in the direction of engagement with said ball valve.

14. A hose nozzle as defined in claim 13 wherein said fixed body structure comprises a molded plastic body member defining said barrel portion and said outlet passage portion extending therein, said plastic body member including a first inner conduit section leading to said outlet passage portion and an outer annular wall surrounding said first inner conduit section, said annular wall having an open end spaced from the juncture of said hand grip portion and said barrel portion, said annular wall providing said exterior surface means and a molded plastic inlet member including a closure section mounted in closing relation to the open end of said annular wall, said coupling means being provided in said closure section, said inlet member also including a second inlet conduit section defining said inlet passage portion extending inwardly from said coupling means in spaced relation with said annular wall into communicating relation with said first inner conduit section so that said second inlet conduit section, said first inner conduit section and said outlet passage portion define a water passage extending from said coupling means to said outlet end which is disposed in temperature insulating relation with respect to said manually engageable exterior surface means of said annular wall.

15. A hose nozzle as defined in claim 14 wherein said spring means comprises a coil spring mounted between said tubular member and an inner end of said second inlet conduit section.

16. A hose nozzle as defined in claim 13 wherein said knob includes a pair of diametrically opposed thumb engaging levers extending on opposite sides of said abutment so as to accommodate both left and right handed users, said abutment extending rearwardly of said knob to shield the same from hard surface contact from the rear, said fixed body structure providing a ledge portion overlying said knob to shield the same from hard surface contact from above.

17. A hose nozzle as defined in claim 1 wherein said ball valve is mounted for movement between said opened and closed positions by a tubular member having an outwardly flared inner end portion engaging a spaced generally opposed annular portion of said ball valve, and spring means for resiliently biasing said tubular member in the direction of engagement with said ball valve.

18. A hose nozzle as defined in claim 17 wherein said spring means comprises a coil spring mounted between said tubular member and a tubular support fixed within said inlet passage portion.

19. A hose nozzle as defined in claim 1 wherein said knob includes a pair of diametrically opposed thumb engaging levers extending on opposite sides of said abutment so as to accommodate both left and right handed users, said abutment extending rearwardly of said knob to shield the same from hard surface contact from the rear, said fixed body structure providing a ledge portion overlying said knob to shield the same from hard surface contact from above.

20. A hose nozzle comprising a molded plastic body including a hand grip portion and a barrel portion extending at an angle from the hand grip portion, said barrel portion defining an outlet passage portion extending inwardly from an outlet end thereof to a position of juncture between said barrel portion and said hand grip portion, said hand grip portion including a first inner conduit section leading to said outlet passage portion and an outer annular wall surrounding said first inner conduit section, said annular wall having an open end spaced from the juncture of said hand grip portion with said barrel portion and exterior surface means shaped for manual engagement by a user, a molded plastic inlet structure including a closure section mounted in closing relation to the open end of said annular wall, said closure section having inlet hose coupling means therein for communicating therewith a source of water under pressure contained in a hose and a second inlet conduit section extending inwardly from said coupling means in spaced relation with said annular wall into communicating relation with said first inner conduit section so that said second inlet conduit section, said first inner conduit section and said outlet passage portion define a water passage extending from said coupling means to said outlet end which is disposed in temperature insulating relation with respect to the manually engageable exterior surface means of said annular wall, valve means mounted in said water passage for manual movement between opened and closed positions with respect to said water passage for controlling flow of water under pressure communicated with said coupling means with said outlet end, and spray pattern defining means in said outlet end for directing water under pressure flowing to said outlet end outwardly thereof in a predetermined spray pattern.

21. A hose nozzle as defined in claim 20 wherein said valve means comprises a ball valve, means mounting said ball valve in said first inner conduit section for movement between said opened and closed positions, said ball valve mounting means including an O-ring mounted within an annular groove in said first inner conduit section in sealingly engaged relation with a first annular portion of said ball valve, a tubular member having an outwardly flared inner end portion engaging a second opposed annular portion of said ball valve and means for biasing said tubular member in the direction of engagement thereof with said ball valve.

22. A hose nozzle as defined in claim 21 wherein said ball valve is connected with a knob extending exteriorly of said hand grip portion in a position above an abutment on said exterior surface means in a position to engage a user's hand gripping the exterior surface means at a position above the base of the thumb.

23. A hose nozzle as defined in claim 20 wherein said manually adjustable spray pattern defining means comprises a stem member having one end fixed to said outlet end and extending outwardly therefrom, said stem member including a stream deflecting stem on an outwardly extending end of said stem member and a cylindrical exterior surface spaced inwardly from said stream deflecting stem said stem member having flow opening means extending through said one end thereof to the exterior thereof between said stream deflecting stem and said exterior cylindrical surface, said spray pattern defining means also comprising a sleeve member threadedly mounted on said stem member, said sleeve member having interior sealing means engaging said exterior cylindrical surface and a forward end having a nozzle orifice therein movable with respect to said stream deflecting stem in response to turning movements of said sleeve member into varying stream defining positions including a jet stream defining position wherein said nozzle orifice is in an extended spaced position with respect to said stream deflecting stem and a cone spray defining position wherein said nozzle orifice is in a closely spaced position with respect to said stream deflecting stem.

24. A hose nozzle as defined in claim 20 wherein said ball valve seat comprises an O-ring seated in an annular groove formed in an inner end portion of said first inner conduit section and sealingly engaging a first annular portion of said ball valve.

* * * * *

UNITED STATES PATENT AND TRADEMARK OFFICE

CERTIFICATE OF CORRECTION

PATENT NO. : 4,997,131

DATED : March 5, 1991

INVENTOR(S) : Lawrence P. Heren

It is certified that error appears in the above-identified patent and that said Letters Patent is hereby corrected as shown below:

Col. 10, line 8, change "2" to --1--.

Signed and Sealed this

Thirty-first Day of December, 1991

*Attest:*

HARRY F. MANBECK, JR.

*Attesting Officer*

*Commissioner of Patents and Trademarks*